US010060678B2

(12) United States Patent
Xu et al.

(10) Patent No.: US 10,060,678 B2
(45) Date of Patent: Aug. 28, 2018

(54) FALLING FILM EVAPORATOR

(71) Applicant: MCQUAY AIR-CONDITIONING & REFRIGERATION (WUHAN) CO., LTD., Wuhan, Hubei (CN)

(72) Inventors: Feng Xu, Hubei (CN); Linbo Zhang, Hubei (CN); Yi Luo, Hubei (CN); Xin Ma, Hubei (CN); Yingqiu Zhu, Hubei (CN)

(73) Assignee: MCQUAY AIR-CONDITIONING & REFRIGERATION (WUHAN) CO., LTD., Wuhan, Hubei (CN)

( * ) Notice: Subject to any disclaimer, the term of this patent is extended or adjusted under 35 U.S.C. 154(b) by 254 days.

(21) Appl. No.: 14/895,075

(22) PCT Filed: Jun. 20, 2014

(86) PCT No.: PCT/CN2014/080377

§ 371 (c)(1),
(2) Date: Dec. 1, 2015

(87) PCT Pub. No.: WO2015/100965

PCT Pub. Date: Jul. 9, 2015

(65) Prior Publication Data

US 2016/0109182 A1 Apr. 21, 2016

(30) Foreign Application Priority Data

Dec. 30, 2013 (CN) ..... 2013 1 0750441
Apr. 4, 2014 (CN) ..... 2014 1 0138717

(51) Int. Cl.
*F28D 3/04* (2006.01)
*F28D 3/02* (2006.01)
(Continued)

(52) U.S. Cl.
CPC ..... *F28D 3/02* (2013.01); *F25B 31/004* (2013.01); *F25B 39/028* (2013.01); *F28D 3/04* (2013.01);
(Continued)

(58) Field of Classification Search
CPC ..... F28D 3/02; F28D 3/04
(Continued)

(56) References Cited

U.S. PATENT DOCUMENTS 1,918,005 A * 7/1933 Urquhart ..... B01D 3/20 261/114.1
2,055,048 A * 9/1936 Puls ..... B01D 3/205 261/114.1
(Continued)

FOREIGN PATENT DOCUMENTS

CN 1185202 A 6/1998
CN 101382359 A 3/2009
(Continued)

OTHER PUBLICATIONS

International Search Report of corresponding PCT Application No. PCT/CN2014/080377 dated Sep. 28, 2014.
(Continued)

*Primary Examiner* — Allen Flanigan
(74) *Attorney, Agent, or Firm* — Global IP Counselors, LLP

(57) ABSTRACT

The present application discloses a falling film evaporator including a barrel that is provided with an upper distributor at an inner upper side thereof, gas barriers are respectively provided at both sides of the top of the upper distributor, at least one gas barrier is provided with sawteeth at the edge thereof, a gas flowing channel is formed by the sawteeth and the inner wall of the barrel in an encircled manner and is communicated with the gas refrigerant outlet, at the bottom
(Continued)

of the both side walls of the upper distributor is respectively provided with a turbulent flow plate, an upper heat exchange tube group is provided below the upper distributor, a lower heat exchange tube group is provided below the upper heat exchange tube group, an oil enriched area provided with a liquid level sensor is provided below the lower heat exchange tube group, a signal output end of the liquid level sensor is connected with a signal input end of the throttle device, and oil return ports are opened at the oil enriched area. The falling film evaporator may switch between full falling film heat exchange mode and mixed falling film heat exchange mode, thereby preventing refrigerant dripping to the bottom for use in heat exchange from being insufficient or preventing refrigerant filling quantity from being too large, and meanwhile also avoiding the phenomenon of carrying liquid during air suction and improving heat transfer coefficient and heat exchange efficiency.

26 Claims, 7 Drawing Sheets

(51) Int. Cl.

| | |
|---|---|
| ***F25B 31/00*** | (2006.01) |
| ***F28F 25/02*** | (2006.01) |
| ***F28D 5/02*** | (2006.01) |
| ***F25B 39/02*** | (2006.01) |
| *F28D 7/16* | (2006.01) |

(52) U.S. Cl.
CPC ..... *F28D 5/02* (2013.01); *F28F 25/02* (2013.01); *F25B 2339/0242* (2013.01); *F28D 7/16* (2013.01)

(58) Field of Classification Search
USPC ..... 165/117
See application file for complete search history.

(56) References Cited

U.S. PATENT DOCUMENTS

| | | | | |
|---|---|---|---|---|
| 5,645,124 | A * | 7/1997 | Hartfield et al. | B01D 1/04 165/117 |
| 6,868,695 | B1 | 3/2005 | Dingel et al. | |
| 2006/0169111 | A1* | 8/2006 | Kozlowski | B23D 59/003 83/13 |
| 2008/0149311 | A1* | 6/2008 | Liu et al. | F25B 39/028 165/115 |
| 2010/0326108 | A1* | 12/2010 | Schreiber et al. | F25B 39/028 62/218 |
| 2011/0017432 | A1* | 1/2011 | Kulankara et al. | F28D 3/02 165/115 |

FOREIGN PATENT DOCUMENTS

| | | | |
|---|---|---|---|
| CN | 102000437 | A | 4/2011 |
| CN | 102166420 | A | 8/2011 |
| CN | 203083207 | U | 7/2013 |
| CN | 203224070 | U | 10/2013 |
| CN | 103727707 | A | 4/2014 |
| WO | 96/37741 | A1 | 11/1996 |

OTHER PUBLICATIONS

European Search Report of corresponding EP Application No. 14 87 7120.7 dated Jul. 21, 2017.

* cited by examiner

FALLING FILM EVAPORATOR

FIELD OF THE PRESENT APPLICATION

The present application relates to an air-conditioner, and more specifically, to a falling film evaporator.

BACKGROUND OF THE PRESENT APPLICATION

In the refrigeration and air-conditioning industry, there mainly are two types of evaporators used in an high-efficiency water chilling (heat pump) unit, namely a flooded evaporator and a falling film evaporator, wherein the falling film evaporator has the advantages of high heat exchange efficiency, less refrigerant filling quantity and the like in comparison with the flooded evaporator, therefore, application prospect of the falling film evaporator is more widely. The falling film evaporator includes full falling film mode and mixed falling film mode, the full falling film mode means that all of heat exchange tubes of the evaporator are in the state of falling film heat exchange, that is to say, none of heat exchange tubes are immersed in liquid refrigerant, it has the advantage of being capable to furthest reduce refrigerant filling quantity; the mixed falling film mode means that one part of heat exchange tubes of the evaporator are in the state of falling film heat exchange, the other part of heat exchange tubes are in the state of flooded heat exchange, which are immersed in liquid refrigerant, it has the advantage of fully utilizing heat exchange area since the heat exchange tubes at the bottom of the evaporator are immersed in liquid refrigerant. At present, the falling film evaporator has the following disadvantages: 1) refrigerant dripping to the heat exchange tubes at the bottom of the full falling film evaporator is insufficient, which, in turn, results in that the utilization of heat exchange area is not maximized; 2) the mixed falling film evaporator maintains a high refrigerant liquid level at the bottom thereof, and refrigerant at the bottom of the evaporator has a high oil content, these factors cause that heat transfer coefficient of the lower heat exchange tube group is low, and refrigerant filling quantity increases since a large amount of liquid refrigerant exists in the bottom of the evaporator; 3) because of design limitation, velocity field of gas refrigerant inside the evaporator is not reasonable, a region with high flow velocity concentrates on the vicinity of the refrigerant outlet, phenomenon of carrying liquid during air suction often arises, and high speed airflow easily forms turbulence for liquid refrigerant, and consequently reduces heat exchange efficiency.

SUMMARY OF THE PRESENT APPLICATION

An object of the present application is to provide a falling film evaporator. The falling film evaporator may switch between full falling film heat exchange mode and mixed falling film heat exchange mode, thereby preventing refrigerant dripping to the bottom for use in heat exchange from being insufficient or preventing refrigerant filling quantity from being too large, and meanwhile also avoiding phenomenon of carrying liquid during air suction and improving heat transfer coefficient and heat exchange efficiency.

To achieve the aforementioned object, the technical solution of the present application is as follow: A falling film evaporator includes a barrel that is provided with tube plates at both ends of said barrel and with a liquid refrigerant inlet and a gas refrigerant outlet at the top of said barrel, a throttle device is provided at the liquid refrigerant inlet; the barrel is provided with an upper distributor at an inner upper side thereof, gas barriers are respectively provided at both sides of the top of the upper distributor and at least one gas barrier is provided with sawteeth at the edge thereof, a gas flowing channel is formed by the sawteeth and the inner wall of the barrel in an encircled manner and is communicated with the gas refrigerant outlet; the upper distributor is respectively provided with a turbulent flow plate at the bottoms of the both side walls thereof; an upper heat exchange tube group is provided below the upper distributor, a lower heat exchange tube group is provided below the upper heat exchange tube group; an oil enriched area provided with a liquid level sensor is provided below the lower heat exchange tube group, a signal output end of the liquid level sensor is connected with a signal input end of the throttle device, and oil return ports are opened in the oil enriched area.

By rational and reasonable design for structure of the upper distributor, the evaporator of the present application uniformly distributes refrigerant, achieve homogeneous film distribution of liquid refrigerant formed on heat exchange tube group of the housing of the evaporator, and form falling film heat exchange, and meanwhile it is ensured that refrigerant uniformly drips to the upper heat exchange tube group in the form of columnar flow, thereby preventing excessive distribution or insufficient distribution from causing decline of heat transfer efficiency and preventing liquid refrigerant from splashing. In addition, the provided liquid level sensor may detect liquid level of refrigerant of the oil enriched area at the bottom of the evaporator, and then control the throttle device to be turned down or turned up, so that liquid level of refrigerant of the oil enriched area at the bottom of the evaporator is below the lower heat exchange tube group or immerses a part of the heat exchange tubes of the lower heat exchange tube group, so as to get the falling film evaporator to operate in the heat exchange state of full falling film or mixed falling film. By coordinating the refrigerant distribution mechanism with the liquid level sensor, the evaporator may switch between full falling film heat exchange mode and mixed falling film heat exchange mode, so as to selecting corresponding mode according to the actual condition, thereby preventing refrigerant dripping to the bottom for use in heat exchange from being insufficient or preventing refrigerant filling quantity from being too large, and thereby sufficiently utilizing heat exchange area, improving heat transfer coefficient and heat exchange efficiency, and improving performance coefficient of the entire water chilling unit. Moreover, whether the performance of the return oil system of the refrigeration (or heating) system employing the evaporator is good or bad depends on a suitable liquid level position, therefore, the liquid level sensor improves the performance of the return oil system, and a return oil solution suitable for the falling film evaporator is provided. In the present application, the gas barrier is provided, the edge thereof is set to be sawteeth-shaped, and a refrigerant gas flowing channel is formed by the sawteeth and the inner wall of the barrel, from this, velocity field distribution of refrigerant in the evaporator is optimized, so as to disperse high flow velocity region concentrated on the vicinity of the gas refrigerant outlet in a lengthwise direction of the barrel through the aforementioned gas flowing channel; flow velocity of each region, which is formed by the sawteeth on the gas barrier segmenting the originally comparatively concentrated high flow velocity region, is more uniformly, thereby preventing concentrated high flow velocity region from arising, so that flow velocity of gas refrigerant of the region close to the gas refrigerant outlet and the upper heat exchange tube group decreases to 0.2~1.2 m/s from 2.5 m/s or more, thus, possibility of carrying liquid during air suction of compressor is greatly reduced, compressor lifetime is lengthened, and superheat degree of gas refrigerant discharged from an exhaust end of the compressor is increased, thereby avoiding decline of ability of separating refrigeration machine oil of the oil separator in the refrigeration system caused by low superheat degree, so as to ensure normal operation of the oil supply system.

Further, heat transfer coefficient and heat exchange efficiency are improved; as for easily deviating phenomenon of flow direction of gas refrigerant, turbulent flow plates are respectively provided at the bottoms of the two side walls of the distributor, so as to reduce phenomenon of gas deviation.

Further, the upper distributor includes a cover plate, the top of the cover plate is provided with a liquid inlet communicated with the liquid refrigerant inlet, and the edge of the top of the cover plate is opened with a plurality of pressure-balanced holes; the two gas barriers symmetrically are provided at two sides of the top of the cover plate, a first distributing box that has a small size relative to the cover plate is provided below the cover plate, and a plurality of irregular liquid passing apertures are opened at the surrounding wall of the first distributing box; an upper water distribution cushion is provided below the first distributing box, a second distributing box is provided below the upper water distribution cushion, and the bottom of the second distributing box is opened with a plurality of water homogenizing holes, the top edge of the second distributing box is hermetically mated with the bottom edge of the cover plate, and the two turbulent flow plates are symmetrically provided at the bottoms of the outer walls of the two sides of the second distributing box. Function of the turbulent flow plate is that upward flowing trail of gas refrigerant along a radial direction of the evaporator is changed. Since droplets inevitably exist in gas refrigerant, the existing turbulent flow plates make themselves to be collided with droplets when the droplets flow with gas, so that possibility of carrying droplets by gas is reduced, and meanwhile the existing turbulent flow plate can change velocity field of gas refrigerant below the turbulent flow plate, so that velocity on the vicinity of the heat exchange tubes located at the outermost side of heat exchange tube group decreases to 0.2~1.2 m/s from 2 m/s or more, possibility of carrying droplets by gas refrigerant is not only reduced, but it may be also ensured that columnar flow direction between upper heat exchange tube and lower heat exchange tube in the heat exchange tube group is vertical. Function of the first distributing box is that gas and liquid refrigerant mixture is uniformly distributed in a lengthwise direction of the evaporator, that is to say, the evaporator is firstly divided into a number of equal parts in a lengthwise direction, and then by a number of irregular liquid passing apertures provided on the surrounding wall of the first distributing box, mass flux for gas and liquid refrigerant mixture flowing into each equal part in the lengthwise direction approximates, thereby achieving the object of uniform distribution along the lengthwise direction of the evaporator. The upper water distribution cushion absorbs kinetic energy generated by gas and liquid refrigerant mixture ejected from the liquid passing apertures with using elasticity of metal wire cushion, so as to make gas and liquid refrigerant mixture fall into the second distributing box at a relatively low velocity.

Further, the gas barrier has a long strip shape, the sawteeth disposed in a region away from the gas refrigerant outlet are provided at one edge of the gas barrier close to the inner wall of the barrel, the other edge of the gas barrier is fixed on the cover plate.

Further, the flow area of the gas flowing channel formed by the sawteeth edge of the gas barrier and the inner wall of the barrel is in the range of 0.04 to 0.15 $m^2$.

Further, the turbulent flow plate has a rectangle shape and is obliquely provided downwards, the included angle between the turbulent flow plate and the side wall of the second distributing box is in the range of 30° to 60°, the long side of the top of the turbulent flow plate is fixed at the bottom of the side wall of the second distributing box.

Further, the width of the turbulent flow plate is in the range of 30 to 60 mm.

Further, a lower distributor is provided between the upper heat exchange tube group and the lower heat exchange tube group and includes a supporting pull rod, a support net is provided on the supporting pull rod, and a lower water distribution cushion is covered on the support net. Liquid refrigerant dripping from the upper heat exchange tube group easily deviates in gas flow direction under the effect of compressor suction, but the lower distributor can take liquid refrigerant dripping from the upper heat exchange tube, and therefore collect and gather the liquid refrigerant in the lower distributor, so as to achieve the object of uniform redistribution, and then liquid refrigerant continuously drips from the lower distributor; sequentially, liquid refrigerant vertically drops at a lower flow velocity and covers on the lower heat exchange tube group in the state of liquid film, and falling film heat exchange is formed.

Further, the lower water distribution cushion is a metal wire cushion which is composed of metal wires with the diameter of 0.8 to 1.0 mm and has the thickness of 2 to 20 mm.

Further, the upper heat exchange tube group includes a top heat exchange tube group and a bottom heat exchange tube group, a gap channel with the height of 8 to 30 mm is provided between the top heat exchange tube group and the bottom heat exchange tube group. The object of providing the gap channel is that gas refrigerant generated by evaporating liquid refrigerant on the heat exchange tubes may maintain passing at a low velocity, In the premise of gas refrigerant passing at a low velocity, a size of the gap channel may not be too large, so as to prevent liquid refrigerant dripping from the top heat exchange tube group from being disturbed by airflow.

Further, the upper heat exchange tube group and the lower heat exchange tube group are horizontally arranged in the form of aligned arrangement or staggered arrangement. With such arrangement way, the heat exchange tubes can be arranged as many as possible within the limited space.

Further, the upper water distribution cushion is a metal wire cushion which is composed of metal wires with the diameter of 0.8 to 1.0 mm and has the thickness of 9 to 20 mm.

Further, the pressure-balanced hole is a circular hole and has the diameter of 20 to 80 mm, the number of the pressure-balanced holes is 10 to 30.

Further, the flow area of a single liquid passing aperture on the surrounding wall of the first distributing box is in the range of 50 to 200 $mm^2$.

Further, the number of the liquid passing apertures is 20 to 120.

Further, the second distributing box is provided with one or more partition plates at the inner bottom thereof in a lengthwise direction. Function of the partition plate is that liquid refrigerant in the second distributing box is divided into a number of regions, in case the upper distributor and even entire unit incline in the lengthwise direction, the liquid refrigerant may still form refrigerant liquid level with a certain height in each region divided by the partition plates, so as to drip downwards, thereby avoiding a part of heat exchange surfaces of heat exchange tube group at the bottom without liquid film formed on the surfaces.

Further, the height of the partition plate is in the range of 5 to 10 mm, the number of the partition plate is in the range of 1 to 5.

Further, the water homogenizing holes which are circular holes with the diameter of 1 to 5 mm are separately aligned with the heat exchange tubes located on the topmost layer of the upper heat exchange tube group below the water homogenizing holes. By reasonable design for the water homogenizing holes, liquid refrigerant can drip into heat exchange tube group below at proper velocity and will not form splash. The object of aligning water homogenizing holes with the heat exchange tubes located on the topmost layer below the water homogenizing holes one by one is that uniform liquid film may be formed on all of the heat exchange tubes.

Further, 1 to 4 oil return ports is/are opened at the bottom of the oil enriched area.

Further, the oil return port is provided at the lowest position of the oil enriched area. It may be ensured by providing the oil return port at the lowest position of the oil enriched area that the oil return port is always immersed in oil enriched refrigerant.

Further, gas refrigerant channels are provided between the upper distributor and the upper heat exchange tube group and between the upper heat exchange tube group and the lower distributor. The object of providing gas refrigerant channels is to allow gas refrigerant pass smoothly so that vertically dropping trail of liquid refrigerant is not or less affected.

Further, the first distributing box is sealed at the bottom thereof, is opened at the top thereof; and the top circumference of the first distributing box is soldered on the inner top surface of the cover plate.

Further, the cover plate is a box body which has a rectangle shape and of which the bottom is open; the edge cover plate outwards extending is provided at the bottoms of the two side walls of the box body, and the pressure-balanced holes are provided in a region of the edge cover plate away from the gas refrigerant outlet. The pressure-balanced holes may balance pressure inside the upper distributor with pressure inside the evaporator, and the reason why the pressure-balanced holes are provided on the edge cover plate is that liquid is made away from an air suction port of the compressor when liquid spills out from the pressure-balanced holes, so as to prevent spilling liquid from being inhaled by suction of the compressor.

Further, the liquid inlet is cylindrical, the diameter thereof is in the range of 40 to 200 mm. Further, the throttle device is an electronic expansion valve.

DESCRIPTION OF THE PREFERRED EMBODIMENTS

Hereafter, the present application will further be described in detail in combination with figures, which is used to more clearly understand the present application, but does not form limitation for the present application.

Figure 1:
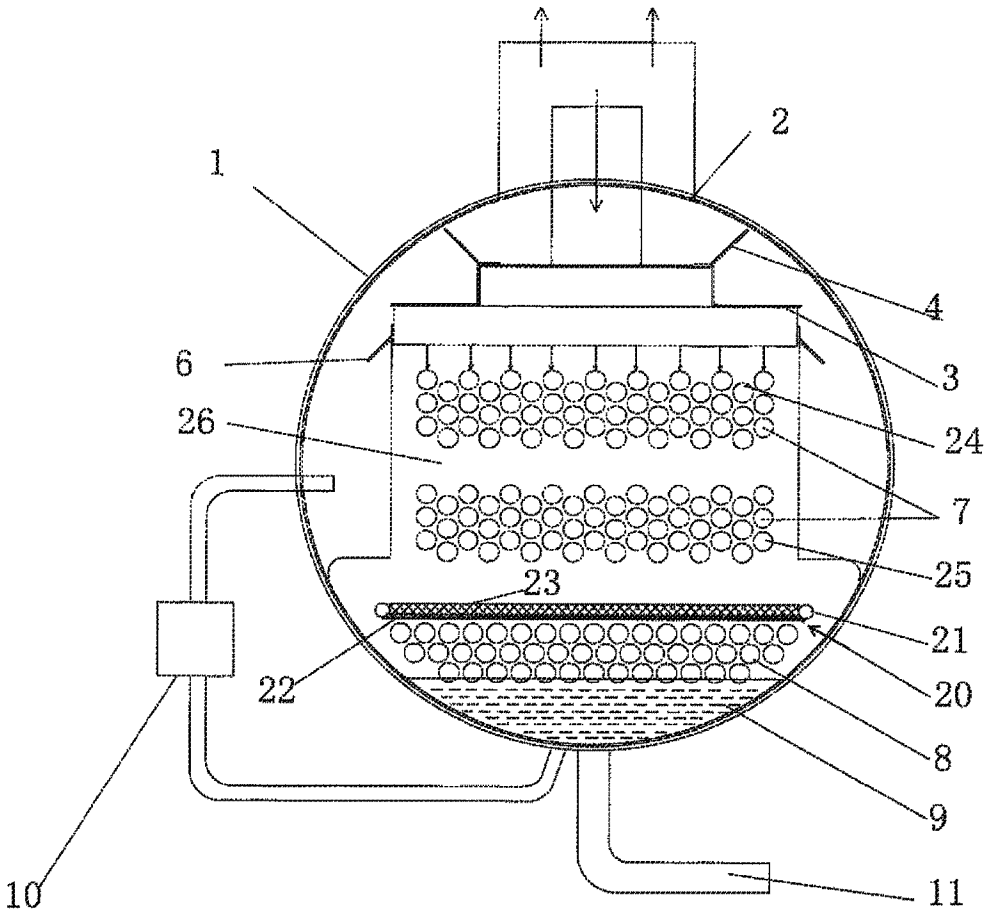
FIG. 1 is a structural schematic view of a section of the falling film evaporator in the state of full falling film.

As shown in FIG. 1, A falling film evaporator includes a barrel 1 that is provided with tube plates at both ends of barrel 1 and with a liquid refrigerant inlet 2 and a gas refrigerant outlet 30 at the top of barrel 1; the liquid refrigerant inlet 2 is provided with a throttle device that may be an electronic expansion valve; the barrel 1 is provided with an upper distributor 3 at inner upper side of barrel 1, gas barriers 4 are respectively provided at both sides of the top of the upper distributor 3 and are respectively provided with sawteeth 5 at the edge of gas barriers 4; a gas flowing channel is formed by the sawteeth 5 and the inner wall of the barrel 1 in an encircled manner and is communicated with the gas refrigerant outlet 30; the upper distributor 3 is respectively provided with a turbulent flow plate 6 at the bottoms of the both sidewalls of the upper distributor 3; an upper heat exchange tube group 7 is provided below the upper distributor 3 and includes a top heat exchange tube group 24 and a bottom heat exchange tube group 25, and a gap channel 26 with the height of 8 to 30 mm is provided between the top heat exchange tube group 24 and the bottom heat exchange tube group 25. A lower distributor 20 is provided below the upper heat exchange tube group 7 and includes a supporting pull rod 21 playing a supporting role, a steel support net 22 is provided on the supporting pull rod 21, and a lower water distribution cushion 23 is provided to cover on the support net 22. The lower water distribution cushion 23 is a metal wire cushion which is composed of metal wires with the diameter of 0.8 to 1.0 mm and has the thickness of 2 to 20 mm. A lower heat exchange tube group 8 is provided below the lower distributor 20, the upper heat exchange tube group 7 and the lower heat exchange tube group 8 are horizontally arranged in the form of aligned arrangement (namely an arrangement of regular triangle which means that three adjacent heat exchange tubes are horizontally placed and distributed in the manner of regular triangle from the view of a cross section of the barrel, as the arrangement of the heat exchange tubes of the lower heat exchange tube group 8 shown in FIG. 1) or staggered arrangement (namely an arrangement of rotated regular triangle which means that three adjacent heat exchange tubes are distributed in the manner of regular triangle rotated by 90 degrees counterclockwise from a horizontal position, from the view of a cross section of the barrel, as the arrangement of the heat exchange tubes of the upper heat exchange tube group 7 shown in FIG. 1); the two ends of each heat exchange tube of the upper heat exchange tube group 7 and the lower heat exchange tube group 8 respectively are in expanding connection with the tube plate to form an enclosed space, an oil enriched area 9 is provided below the lower heat exchange tube group 8 and is provided with a liquid level sensor 10, a signal output end of the liquid level sensor 10 is connected with a signal input end of the throttle device, oil return ports 11 are opened in the oil enriched area 9, the number of the oil return ports 11 at the bottom of the oil enriched area 9 is 1 to 4, the oil return port 11 is provided at the lowest position of the oil enriched area 9. Although most of the material in the oil enriched area is liquid refrigerant, but there also is 2~20 wt % of refrigeration machine oil according to different working conditions and loads; in the case that the content of refrigeration machine oil is high, like being higher than 10%, heat exchange performance of the heat exchange tubes may insufficiently be played if the heat exchange tubes are immersed in refrigeration oil; in the case that the content of refrigeration machine oil is low, like being lower than 4%, the effect of heat exchange may be enhanced if the heat exchange tubes are immersed in refrigeration oil. Thus, this phenomenon can be sufficiently utilized by providing a liquid level sensor used to detect liquid level of the oil enriched area.

Figure 2:
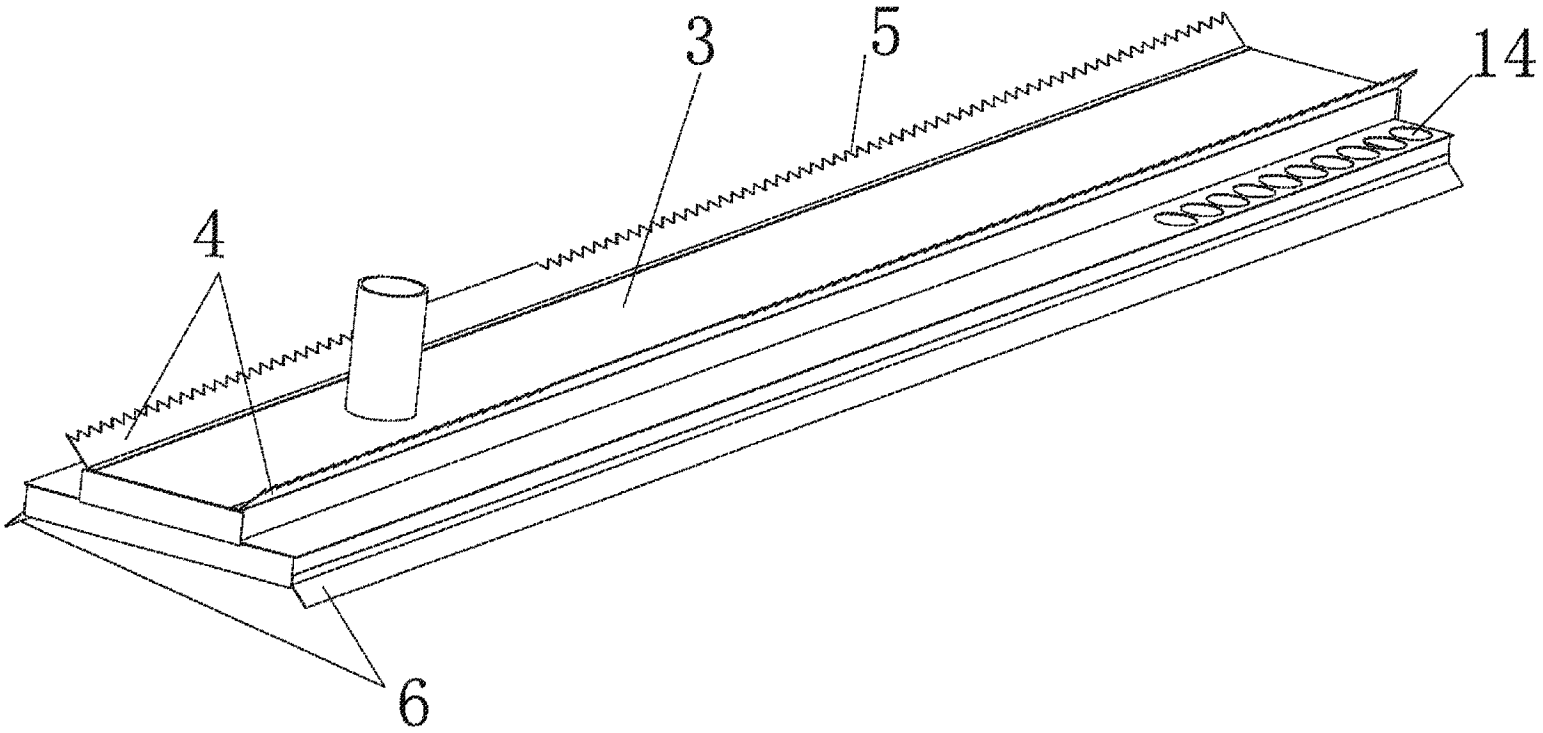
FIG. 2 is a structural schematic view of the upper distributor in FIG. 1.
Figure 3:
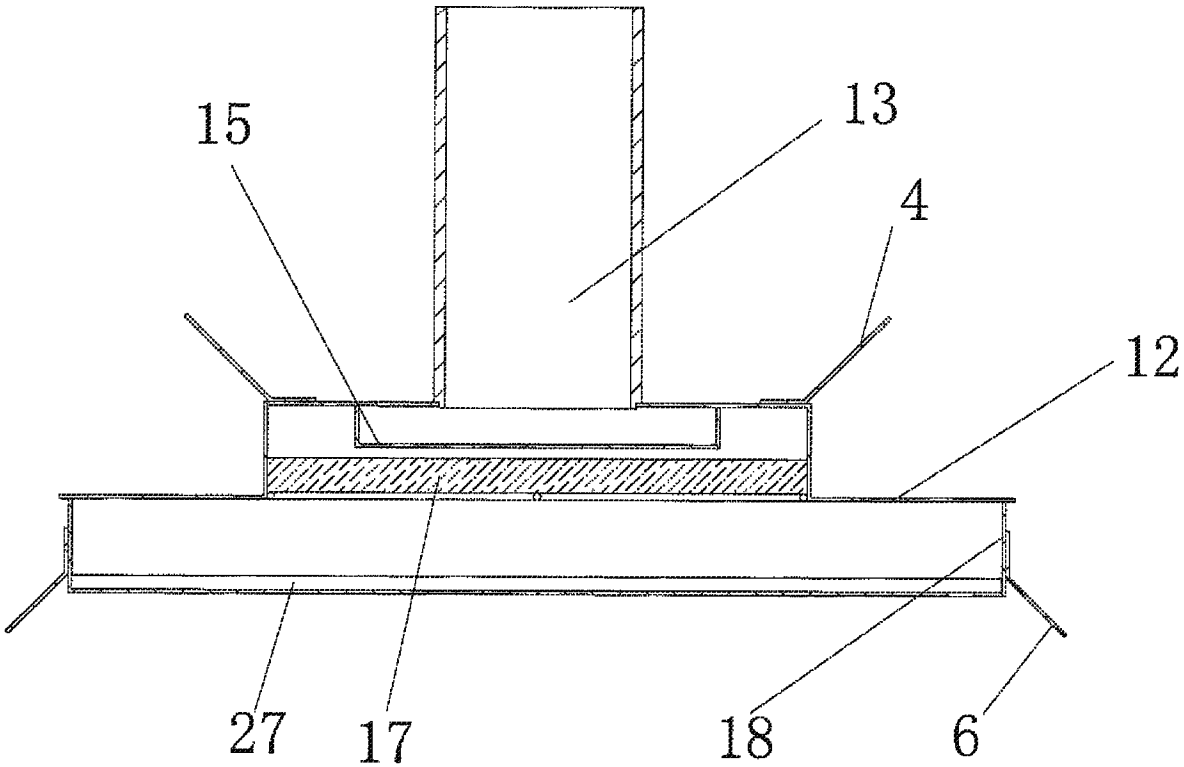
FIG. 3 is a structural schematic view of a section of the upper distributor.
Figure 4:
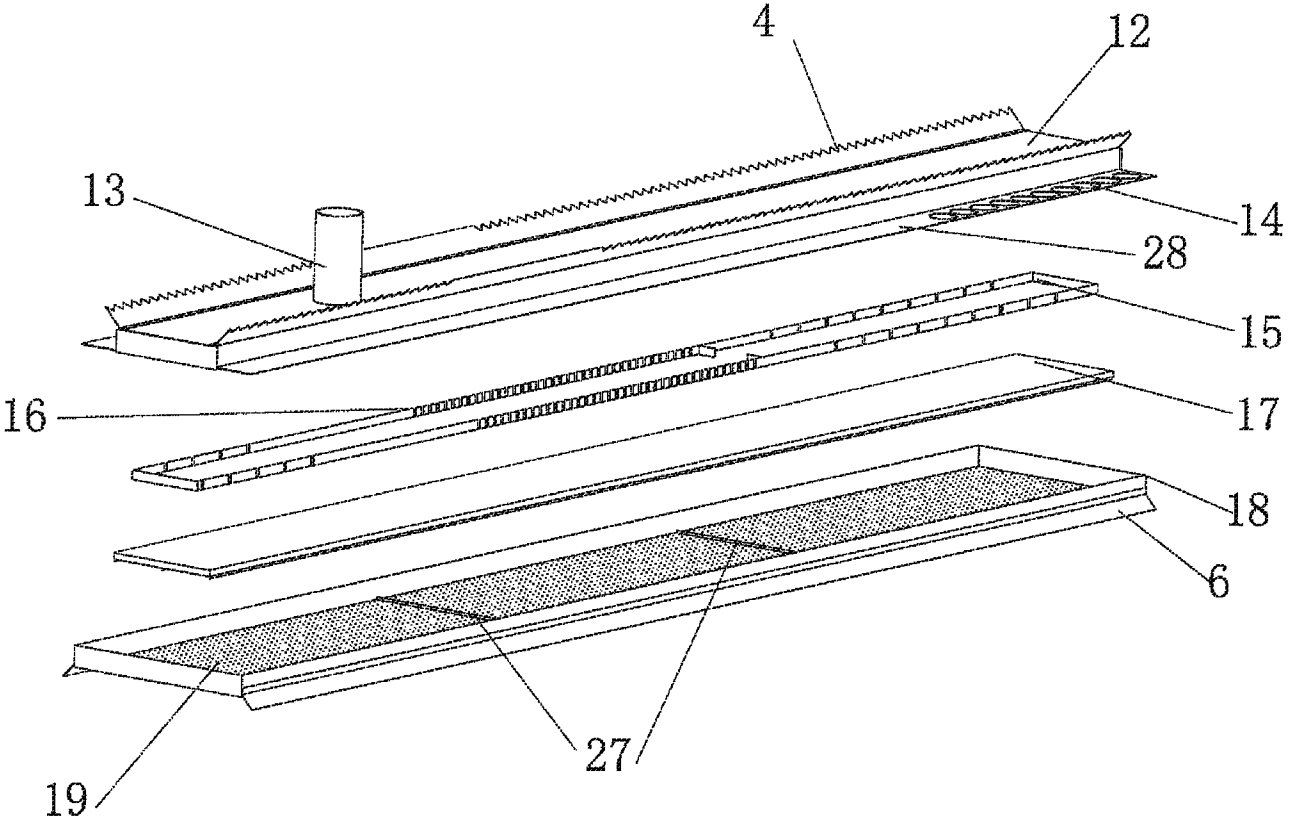
FIG. 4 is an explosive view of FIG. 2.

In combination with FIGS. 2, 3 and 4, the upper distributor 3 includes a cover plate 12 in the aforementioned solution, the cover plate 12 is a box body which has a rectangle shape and of which the bottom is open, the edge cover plate 28 outwards extending is provided at the bottoms of the two side walls of the box body, the cover plate 12 is provided at the top of the cover plate 12 with a liquid inlet 13 communicated with the liquid refrigerant inlet 2; the liquid inlet 13 is cylindrical, is fully soldered on the cover plate 12 and has the diameter of 40 to 200 mm; a plurality of pressure-balanced holes 14 are opened at a region of the edge cover plate 28 away from the gas refrigerant outlet 30; the pressure-balanced hole 14 is a circular hole and has the diameter of 20 to 80 mm, the number of the pressure-balanced holes 14 is 10 to 30; the two gas barriers 4 are symmetrically soldered at two sides of the top of the cover plate 12; below the cover plate 12 is provided a first distributing box 15, which has a small size relative to the cover plate 12 and is opened with a number of irregular liquid passing apertures 16 at the surrounding wall of the first distributing box 15; the flow area of a single liquid passing aperture 16 is in the range of 50 to 200 $mm^2$, the number of the liquid passing apertures 16 is preferably 20 to 120, pressure loss of the first distributing box 15 is preferably controlled as 15 kPa to 60 kPa; an upper water distribution cushion 17 secured on the cover plate 12 by soldering is provided below the first distributing box 15, the upper water distribution cushion 17 is a stainless steel wire cushion which is composed of stainless steel wires with the diameter of 0.8 to 1.0 mm and has the thickness of 9 to 20 mm; a second distributing box 18 is provided below the upper water distribution cushion 17, the top edge of the second distributing box 18 is fully soldered and hermetically mated with the bottom edge of the cover plate 12, the bottom of the second distributing box 18 is opened with a plurality of water homogenizing holes 19, the water homogenizing holes 19 that are circular holes with the diameter of 1 to 5 mm are separately aligned with the heat exchange tubes located on the topmost layer of the upper heat exchange tube group 7 below the water homogenizing holes 19; the second distributing box 18 is soldered with one or more partition plates 27 at the inner bottom of the second distributing box 18 in the lengthwise direction, the height of the partition plate 27 is in the range of 5 to 10 mm, the number thereof is preferably in the range of 1 to 5, and the two turbulent flow plates 6 are symmetrically provided at the bottoms of the outer walls of the two sides of the second distributing box 18, wherein gas refrigerant channels are provided between the upper distributor 3 and the upper heat exchange tube group 24 and between the upper heat exchange tube group 24 and the lower distributor 20.

Figure 5:
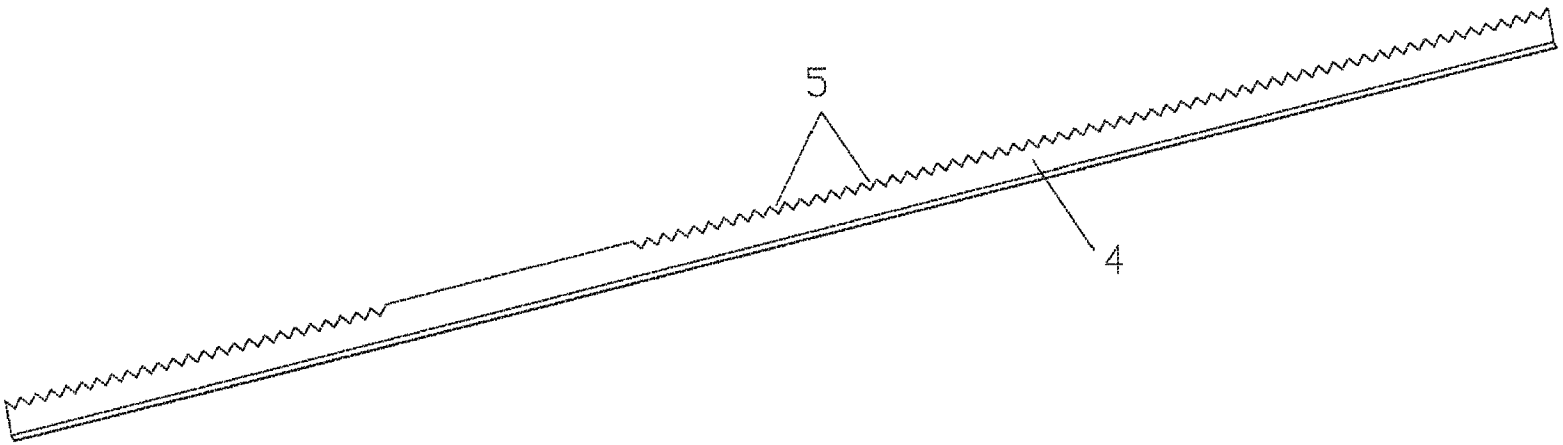
FIG. 5 is a structural schematic view of the gas barrier in FIG. 2.

In combination with what shown in FIG. 5, the gas barrier 4 has a long strip-shaped thin steel plate with sawteeth at one side in the aforementioned solution; the sawteeth 5 are provided in a region away from the gas refrigerant outlet 30 and is provided at one edge of the gas barrier 4 close to the inner wall of the barrel 1, the other edge of the gas barrier 4 is fixed on the cover plate 12. The flow area of the gas flowing channel formed by the sawteeth edge of the gas barrier 4 and the inner wall of the barrel 1 is in the range of 0.04 to 0.15 $m^2$.

The turbulent flow plate 6 has a rectangle shape and is obliquely provided downwards, the included angle between the turbulent flow plate 6 and the side wall of the second distributing box 18 is in the range of 30° to 60°, the long side of the top of the turbulent flow plate 6 is fixed at the bottom of the side wall of the second distributing box 18, the width of the turbulent flow plate 6 is 30 to 60 mm.

Figure 6:
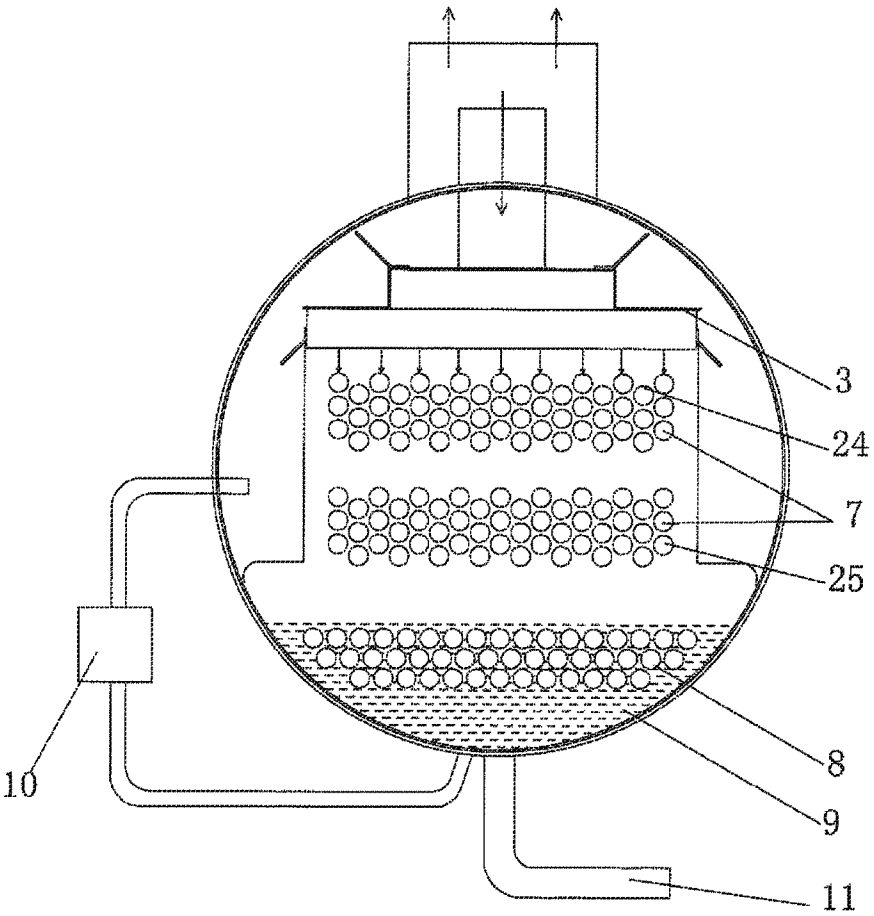
FIG. 6 is a structural schematic view of a section of the falling film evaporator in the state of mixed falling film.
Figure 7:
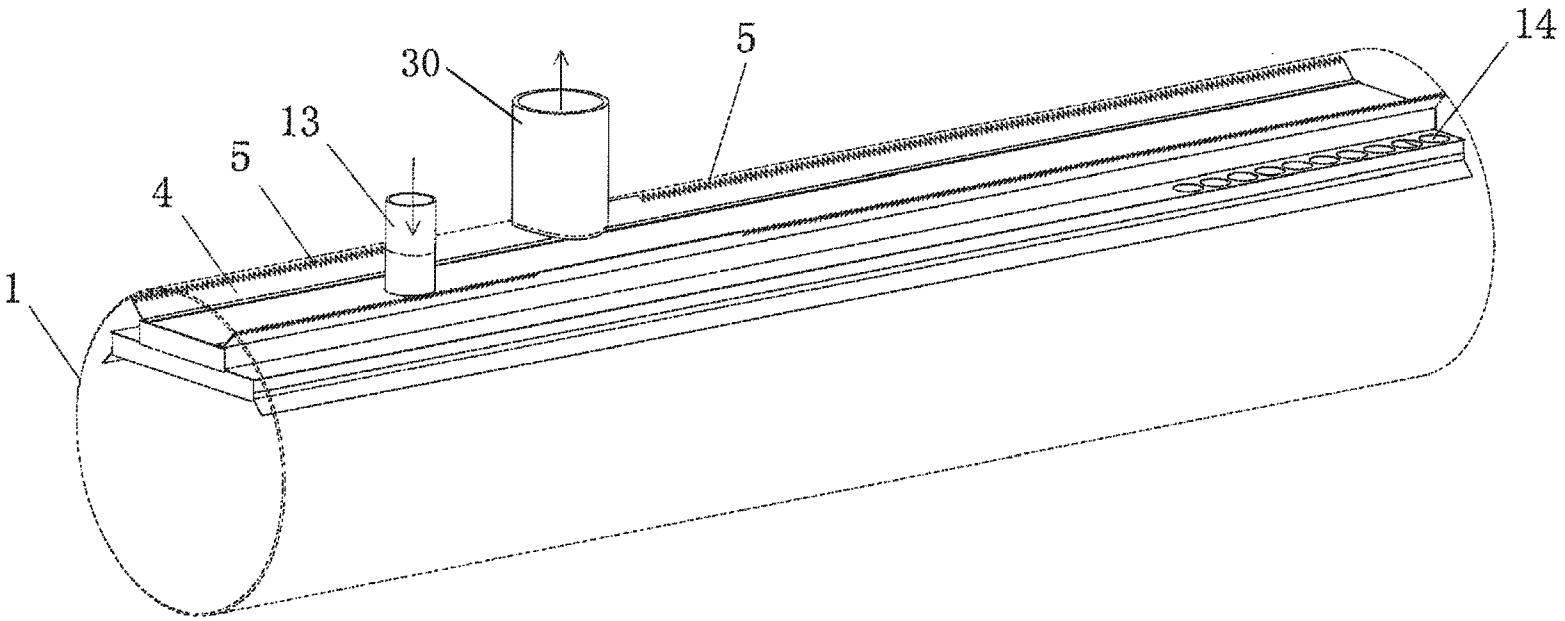
FIG. 7 is a structural schematic view of the barrel, the upper distributor, the liquid inlet, the gas refrigerant outlet.

While an unit configured with the present falling film evaporator operates, whether liquid level of the oil enriched area immerses or does not immerse a part of the heat exchange tubes may be set in advance, if it is unnecessary to immerse, that is to say, the falling film evaporator needs to exchange heat in the state of full falling film, then an unit controller will turn down the opening of the electronic expansion valve to reduce liquid level of the falling film evaporator, for example, when the liquid level sensor detects that liquid level of the oil enriched area is too high and has immersed the heat exchange tubes of the lower heat exchange tube group, the unit controller will turn down the opening of the electronic expansion valve; all of the heat exchange tubes in the falling film evaporator are formed and covered with liquid film on the surface thereof at a stable state; if it is necessary to immerse, that is to say, the falling film evaporator needs to exchange heat in the state of mixed falling film, then the unit controller will turn up the opening of the electronic expansion valve to increase liquid level of the falling film evaporator, so as to immerse a part of the heat exchange tubes, at a stable state, heat exchange with refrigerant is conducted in the situation that the upper heat exchange tubes may entirely be covered by refrigerant liquid film and a part or all of the lower heat exchange tubes is immersed in liquid refrigerant; the lower distributor may be also removed (as shown in FIG. 6) while heat exchange is conducted in the state of mixed falling film. And meanwhile, liquid level of the oil enriched area may not be low without limitation, since too high content (for example, content is more than 50%) of refrigeration machine oil is likely to arise if liquid level of the oil enriched area is too low, which may cause flow resistance of oil return port and the downstream tubes to sharply increase, in turn resulting in difficulty to return oil; in order to avoid this situation, even though the falling film evaporator needs to exchange heat in the state of full falling film, the unit controller will also turn up the opening of the throttle device to dilute refrigerant which has a too high oil content if the liquid level sensor detects that liquid level of the oil enriched area is too low.

When the aforementioned falling film evaporator is in the heat exchange state of full falling film, it has the following working process: liquid refrigerant with high temperature transferred from the condenser becomes a mixed fluid composed of low temperature liquid and low temperature gas after throttled and expanded by the electronic expansion valve, and then enters into the upper distributor 3 of the evaporator from the refrigerant inlet 2 via the liquid inlet 13; after entering into the upper distributor 3, gas and liquid mixture refrigerant fills the entire first distributing box 15, and is uniformly ejected out through the liquid passing apertures 16 that are non-uniformly distributed and having different shapes and sizes at a side face of the first distributing box 15, and impacts the side wall of the cover plate 12; and then droplets (liquid flow) disperse around and drop to the upper water distribution cushion 17; after being absorbed by the upper water distribution cushion 17, liquid refrigerant uniformly distributes and drops into the second distributing box 18, and then uniformly falls onto the upper heat exchange tube group 7 below in the form of columnar flow through the water homogenizing holes 19 provided at the bottom of the second distributing box 18, so as to form film distribution, subsequently, uniform heat exchange with refrigerating medium inside the upper heat exchange tube group 7 is conducted, pressures of inner and outer gas refrigerants of the upper distributor 3 are balanced through the pressure-balanced holes 14 on the cover plate 12; and then, after flowing through the upper heat exchange tube group 7, remaining and non-evaporated liquid refrigerant falls onto the lower distributor 20, and uniformly drips onto the lower heat exchange tube group 8 again after being absorbed by the lower water distribution cushion 23, so as to form film redistribution again, and then heat exchange with refrigerant inside the lower heat exchange tube group 8 is conducted; next, after being evaporated by the lower heat exchange tube group 8, the remaining oil enriched refrigerant is gathered in a free space at the bottom of the lower heat exchange tube group 8, and forms the oil enriched area 9 at the bottom of the evaporator; the communicated pipeline of the evaporator is provided with the liquid level sensor 10, so as to detect liquid level of refrigerant at the bottom of the evaporator and then feedback liquid level of refrigerant to the electronic expansion valve to control refrigerant flux entering into the falling film evaporator from the refrigerant inlet 2, so that liquid level of refrigerant of the oil enriched area 9 at the bottom of the evaporator is lower than the lower heat exchange tube group 8, thereby preventing the lower heat exchange tube group 8 from being immersed in oil enriched refrigerant, so that the falling film evaporator maintains a certain liquid level of refrigerant benefits to return oil from the oil return port 11 at the bottom of the evaporator, oil enriched refrigerant may bring refrigeration machine oil back to the compressor and then enter into the oil separator through jet pump; and meanwhile, all of gas refrigerant evaporated through the heat exchange tubes group is inhaled into the compressor and is compressed by the compressor after discharged from the sawteeth-shaped gas flowing channels on the gas barriers 4 of two sides of the top of the upper distributor 3; the sawteeth-shaped design for the gas barriers 4 may prevent flow velocity of a part of gas refrigerant on the top of the barrel 1 of the evaporator from being too high and thus from carrying liquid during air suction. Herein, a reasonable controlling of pressure drop of the entire first distributing box 15, and amount, size and shape of each liquid passing aperture in the lengthwise direction will benefit to ensure uniform distribution of refrigerant flux in the lengthwise direction.

At the time of implementing heat exchange of the falling film evaporator in the state of full falling film, the present application adopts the upper distributor in which pressure potential energy and gravitational potential energy can coordinate with each other, and utilizes absorption and redistribution of the metal wire cushions of the upper distributor and the lower distributor, therefore it is ensured that liquid refrigerant in the form of columnar flow is distributed onto the upper heat exchange tube group and the lower heat exchange tube group, respectively, so that liquid refrigerant is uniformly distributed onto all of the heat exchange tubes, and it effectively is avoided that over-allocation or under-allocation of refrigerant for the heat exchange tubes results in decline of heat transfer efficiency; therefore, full falling film mode of refrigerant evaporation is achieved, thereby a reduction of refrigerant filling quantity. At the time of implementing heat exchange of the falling film evaporator in the state of mixed falling film, the present application adopts the upper distributor in which pressure potential energy and gravitational potential energy can coordinate with each other, and utilizes the ability of uniform distribution of the upper distributor, and therefore ensures that liquid refrigerant in the form of columnar flow is distributed onto the upper heat exchange tube group, and meanwhile liquid level of refrigerant in the falling film evaporator is increased, so as to immerse a part of the heat exchange tubes in refrigerant, and achieve heat exchange in the state of mixed falling film; consequently, heat exchange area of this kind of heat exchange tubes can be fully utilized, which leads to a maximum utilization rate of heat exchange area, thereby obtaining effect of energy conservation and environmental protection.

The present invention is used in central air-conditioning host system for which user provides chilling water (or hot water), such as centrifugal chilled water (or heat pump) unit and screw chilled water (or heat pump) unit, this kind of unit is mainly composed of a centrifugal or screw compressor, an evaporator, a condenser and a throttle mechanism, and forms a refrigeration (or heating) system loop.

What is claimed is:

1. A falling film evaporator, comprising:

a barrel provided with tube plates at both ends of said barrel and with a liquid refrigerant inlet and a gas refrigerant outlet at the top of said barrel; and a throttle device provided at the liquid refrigerant inlet, wherein:

an upper distributor is provided at inner upper side of said barrel, the upper distributor including a cover plate, a gas barrier is respectively provided at both sides of the top of said upper distributor and at least one gas barrier is provided with sawteeth at the edge of said one gas barrier, the gas barrier having a long strip shape, the sawteeth being provided at one edge of said gas barrier close to the inner wall of said barrel and disposed in a region of the one edge away from the gas refrigerant outlet, each of the sawteeth having a pointed shape that narrows as the sawtooth extends away from the one edge of the gas barrier, the other edge of the gas barrier being fixed on a top surface of the cover plate, a gas flowing channel is formed by the sawteeth and the inner wall of said barrel in an encircled manner and is communicated with the gas refrigerant outlet, a turbulent flow plate is respectively provided at the bottoms of the both sidewalls of said upper distributor, an upper heat exchange tube group is provided below said upper distributor, a lower heat exchange tube group and an oil enriched area are provided below said upper heat exchange tube group, said oil enriched area is provided with a liquid level sensor, a signal output end of said liquid level sensor is connected with a signal input end of said throttle device by unit controller, and at least one oil return port is opened at said oil enriched area.

2. The falling film evaporator according to claim 1, wherein the top of the cover plate is provided with a liquid inlet communicated with the liquid refrigerant inlet, and the edge of the top of the cover plate is opened with a plurality of pressure-balanced holes, two of said gas barriers are symmetrically provided at two sides of the top of the cover plate, a first distributing box is provided below the cover plate, said first distributing box having a small size relative to the cover plate and being opened with a plurality of liquid passing apertures the surrounding wall of said first distributing box, an upper water distribution cushion is provided below said first distributing box, a second distributing box is provided below said upper water distribution cushion and the bottom of said second distributing box is opened with a plurality of water homogenizing holes, the top edge of said second distributing box is hermetically mated with the bottom edge of the cover plate, and the two turbulent flow plates are symmetrically provided at the bottoms of the outer walls of the two sides of said second distributing box.

3. The falling film evaporator according to claim 1, wherein the flow area of the gas flowing channel formed by the sawteeth edge of said gas barrier and the inner wall of said barrel is in the range of 0.04 to 0.15 $m^2$.

4. The falling film evaporator according to claim 1, wherein the turbulent flow plate has a rectangle shape and is provided obliquely downwards, an included angle between the turbulent flow plate and the side wall of said second distributing box is in the range of 30° to 60°, the long side of the top of the turbulent flow plate is fixed at the bottom of the side wall of said second distributing box.

5. The falling film evaporator according to claim 1, wherein the width of the turbulent flow plate is in the range of 30 to 60 mm.

6. The falling film evaporator according to claim 1, wherein a lower distributor is provided between said upper heat exchange tube group and said lower heat exchange tube group, and includes a supporting pull rod, a support net is provided on the supporting pull rod, and is covered with a lower water distribution cushion.

7. The falling film evaporator according to claim 6, wherein the lower water distribution cushion is a metal wire cushion composed of metal wires with the diameter of 0.8 to 1.0 mm, and has the thickness of 2 to 20 mm.

8. A falling film evaporator, comprising:

a barrel provided with tube plates at both ends of said barrel and with a liquid refrigerant inlet and a gas refrigerant outlet at the top of said barrel;

a throttle device provided at the liquid refrigerant inlet, wherein;

an upper distributor is provided at inner upper side of said barrel, a gas barrier is respectively provided at both sides of the top of said upper distributor and at least one gas barrier is provided with sawteeth at the edge of said one gas barrier, a gas flowing channel is formed by the sawteeth and the inner wall of said barrel in an encircled manner and is communicated with the gas refrigerant outlet, a turbulent flow plate is respectively provided at the bottoms of the both sidewalls of said upper distributor, an upper heat exchange tube group is provided below said upper distributor, a lower heat exchange tube group and an oil enriched area are provided below said upper heat exchange tube group, said oil enriched area is provided with a liquid level sensor, a signal output end of said liquid level sensor is connected with a signal input end of said throttle device by unit controller, and at least one oil return port is opened at said oil enriched area, said upper heat exchange tube group includes a top heat exchange tube group and a bottom heat exchange tube group, and a gap channel with the height of 8 to 30 mm is provided between the top heat exchange tube group and the bottom heat exchange tube group.

9. The falling film evaporator according to claim 1, wherein said upper heat exchange tube group and said lower heat exchange tube group are horizontally arranged in the form of aligned arrangement or staggered arrangement.

10. A falling film evaporator, comprising:

a barrel provided with tube plates at both ends of said barrel and with a liquid refrigerant inlet and a gas refrigerant outlet at the top of said barrel;

a throttle device provided at the liquid refrigerant inlet, wherein;

an upper distributor is provided at inner upper side of said barrel, a gas barrier is respectively provided at both sides of the top of said upper distributor and at least one gas barrier is provided with sawteeth at the edge of said one gas barrier, a gas flowing channel is formed by the sawteeth and the inner wall of said barrel in an encircled manner and is communicated with the gas refrigerant outlet, a turbulent flow plate is respectively provided at the bottoms of the both sidewalls of said upper distributor, an upper heat exchange tube group is provided below said upper distributor, a lower heat exchange tube group, and an oil enriched area are provided below said upper heat exchange tube group, said oil enriched area is provided with a liquid level sensor, a signal output end of said liquid level sensor is connected with a signal input end of said throttle device by unit controller, and at least 1 oil return port is opened at said oil enriched area, said upper water distribution cushion is a metal wire cushion composed of metal wires with the diameter of 0.8 to 1.0 mm, and has the thickness of 9 to 20 mm.

11. The falling film evaporator according to claim 2, wherein each of the pressure-balanced hole is a circular hole and has the diameter of 20 to 80 mm, the number of the pressure-balanced holes is 10 to 30.

12. The falling film evaporator according to claim 2, wherein the flow area of a single liquid passing aperture in the surrounding wall of said first distributing box is in the range of 50 to 200 $mm^2$.

13. The falling film evaporator according to claim 2, wherein the number of the liquid passing apertures is 20 to 120.

14. The falling film evaporator according to claim 2, wherein one or more partition plates is/are provided in a lengthwise direction at the inner bottom of said second distributing box.

15. The falling film evaporator according to claim 2, wherein the height of the partition plate is in the range of 5 to 10 mm, the number of the partition plate is in the range of 1 to 5.

16. The falling film evaporator according to claim 2, wherein the water homogenizing holes that are circular holes with the diameter of 1 to 5 mm are respectively aligned with the heat exchange tubes located on the topmost layer of said upper heat exchange tube group below the water homogenizing holes.

17. The falling film evaporator according to claim 1, wherein:

the number of the at least one oil return port at the bottom of the oil enriched area is 1 to 4.

18. The falling film evaporator according to claim 1, wherein the at least one oil return port is provided at the lowest position of the oil enriched area.

19. The falling film evaporator according to claim 6, wherein gas refrigerant channels are provided between said upper distributor and the upper heat exchange tube group and between the upper heat exchange tube group and said lower distributor.

20. The falling film evaporator according to claim 2, wherein said first distributing box is sealed at the bottom thereof and is opened at the top thereof, the top circumference of said first distributing box is soldered on the inner top surface of the cover plate.

21. The falling film evaporator according to claim 2, wherein the cover plate is a box body of a rectangle shape and the bottom of the box body is open, edge cover plate outwards extending is provided at the bottoms of the two side walls of the box body, the pressure-balanced holes are provided in a region of the edge cover plate away from the gas refrigerant outlet.

22. The falling film evaporator according to claim 1, wherein the liquid inlet is cylindrical, the diameter thereof is in the range of 40 to 200 mm.

23. The falling film evaporator according to claim 1, wherein said throttle device is an electronic expansion valve.

24. The falling film evaporator according to claim 1, wherein the sawteeth are provided along the entirety of the one edge except that an intermediate portion of the one edge of each of the gas barriers is not provided with the sawteeth.

25. The falling film evaporator according to claim 24, wherein the pressure-balanced holes are provided in a region of the edge cover plate that is offset from the intermediate portions of the gas barriers in a longitudinal direction of the gas barriers.

26. The falling film evaporator according to claim 2, wherein the liquid passing apertures are non-uniformly distributed along the side face of the first distributing box and have different shapes and sizes.

* * * * *